US008439195B2

(12) United States Patent
Perl et al.

(10) Patent No.: US 8,439,195 B2
(45) Date of Patent: May 14, 2013

(54) PACK OF SEVERAL CONTAINERS AND METHOD FOR THE PRODUCTION OF THE PACK

(75) Inventors: Kurt Perl, Rimsting (DE); Michael Hartl, Raubling (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 12/925,146

(22) Filed: Oct. 13, 2010

(65) Prior Publication Data

US 2011/0089055 A1 Apr. 21, 2011

(30) Foreign Application Priority Data

Oct. 16, 2009 (DE) ..... 10 2009 044 271

(51) Int. Cl.
*B65D 65/00* (2006.01)
*B65D 75/00* (2006.01)
*B65D 5/00* (2006.01)

(52) U.S. Cl.
USPC ..... 206/428; 206/150

(58) Field of Classification Search ..... 206/428, 206/141–143, 150; 53/399; 215/396, 399
See application file for complete search history.

(56) References Cited

U.S. PATENT DOCUMENTS

| | | | | |
|---|---|---|---|---|
| 3,330,408 | A * | 7/1967 | Wanderer | 206/150 |
| 3,388,791 | A * | 6/1968 | Walsh | 206/162 |
| 3,813,123 | A | 5/1974 | Owen | 294/87.2 |
| 4,628,666 | A * | 12/1986 | Lems | 53/398 |
| 4,828,110 | A * | 5/1989 | Lems | 206/427 |
| 4,893,712 | A * | 1/1990 | Allen et al. | 206/150 |
| 5,154,288 | A | 10/1992 | Gloeyer | 206/427 |
| 5,570,787 | A | 11/1996 | Danovaro et al. | 206/428 |
| 5,775,486 | A | 7/1998 | Edqvist | 206/145 |
| 6,039,181 | A * | 3/2000 | Whiteside | 206/428 |
| 6,041,572 | A * | 3/2000 | Gandini | 53/399 |
| 2004/0178636 | A1 | 9/2004 | Iwanami et al. | 290/40 |
| 2005/0086910 | A1 * | 4/2005 | Chambers et al. | 53/399 |
| 2006/0255006 | A1 * | 11/2006 | Wagenknecht et al. | 215/396 |
| 2011/0089055 | A1 * | 4/2011 | Perl et al. | 206/139 |

FOREIGN PATENT DOCUMENTS

| | | | |
|---|---|---|---|
| DE | 1 457 489 | A | 11/1971 |
| DE | 693 11 338 | T2 | 12/1997 |
| DE | 102004011166 | | 5/2005 |
| DE | 20 2006 000 215 | U1 | 3/2006 |
| DE | 20 2008 005 594 | U1 | 7/2008 |
| DE | 10 2008 020 522 | A1 | 10/2009 |
| EP | 0 142 360 | A2 | 5/1985 |
| EP | 0392996 | A1 | 10/1990 |
| EP | 1 886 921 | A1 | 2/2008 |
| JP | 10 059 379 | | 3/1998 |
| WO | WO 8907075 | A1 | 8/1989 |

* cited by examiner

*Primary Examiner* — Luan K Bui
*Assistant Examiner* — Rafael Ortiz
(74) *Attorney, Agent, or Firm* — Davidson, Davidson & Kappel, LLC

(57) ABSTRACT

A pack, including at least two PET containers combined with each other, which are held together by a strip-like or ribbon-like compact strapping. The pack is provided with a carrier handle, which overstretches one top side of the pack and is fixed at the lateral surface areas of two PET containers which are arranged opposite of each other, next to each other or adjacent to each other, joints between the carrier handle and the respective PET container being at least partially arranged within the strapping.

16 Claims, 5 Drawing Sheets

PACK OF SEVERAL CONTAINERS AND METHOD FOR THE PRODUCTION OF THE PACK

This claims the benefit of German Patent Application 10 2009 044 271.5, filed Oct. 16, 2009 and hereby incorporated by reference herein.

The present invention relates to a pack as well as to a method for the production of a pack, which comprises at least four PET (polyethylene terephthalate) containers combined with each other, which are held together by means of a strip-like or ribbon-like compact strapping and said strapping being spun about an outer surface of the PET containers in a horizontal manner, and wherein said pack is provided with a carrier handle which overstretches one top side of the pack.

BACKGROUND

Different possibilities regarding the combination of single articles to larger packs are already known. Thus, containers for beverages, for example, are combined and packed to packs of four, six or more containers mostly by means of shrink films. Mostly, the production of packs is necessary, since packs are the most frequent alternative of sales units for containers for beverages and bottles made of PET polymer. The packs are in parts combined once more for transport purposes and/or arranged in layers and palletized.

The shrink films used for the production of known packs are in need of certain production steps which on the other hand demand a relatively high need of energy. Besides, the used film causes production costs, costs for supply and for the handling as well as for later disposal, since said films are no longer needed after the sale. Likewise, the machinery equipment for the supply of the so called film wrapping modules and other handling stations causes high investment costs. Finally, the supply of the so called shrinking tunnel, wherein the film, which is being wrapped about the packs, is being shrinked about the bottles by means of hot air admission, also causes relatively major capital investment.

Furthermore, the containers can be held together and combined with each other to one pack by means of so called strapping strips. When using such strapping strips, however, a problem can arise in the fact that the packs do not remain rugged due to no definite allocation of the containers. The containers neither form a rugged longitudinal formation nor a diagonal formation of the packs after such a strapping. The reason is that the containers and hence the pack can be positioned from a longitudinal formation into a diagonal formation or vice versa by means of mechanic influence during the transport in further processing machines. Likewise, no higher tension of the strapping strips leads to the minimization of the shifting of the containers, since a rolling-off of the cylindrical containers against each other cannot be reliably avoided. A reason for this fact is, for example, that the containers, particularly the PET containers, are not dimensionally stable.

DE 20 2006 000 215 U1 discloses a pack which comprises products which are held together by a packing material. The packing material has two packing sections that stick together to strongly and firmly hold the products together. An adhesive strip is provided at one end of the packing material and spun about the products, wherein an overlap of the two ends is created. The package material sections formed thereof are fastened in an adhesive manner about the products by means of forces which hold said products together. It is proposed to provide an adhesive strip at an outer surface of a free end of the strip-like packaging material so that the free end of the packaging material is self-adhesive. In this embodiment of a pack, the containers can be shifted in their formation and do not remain rugged in the pack.

DE 693 11 338 T2 discloses a bundling-up device for container sets which comprises a membrane made of plastic material and is defined by a tubular band adapted to wrap and tighten a predetermined number of containers disposed in side by side relation, at side portions thereof, as well as a carrying handle for handling the unitary container set.

A pack with several bottles is known from DE 1 457 489 A, wherein said bottles are held together by means of endless strips in order to form a package. A handle serves for carrying the package.

An extruded plastic container carrier is known from US 38 13 123 A, wherein said extruded plastic container carrier comprises ribbons of greater vertical than horizontal measurement being formed of plastic material which has been extruded and fused in the molten or semi-molten state.

A carrier device and a package including it is known from EP 0 142 360 A2. A package for bottles for similar containers uses a single sheet-like resilient carrier device including a series of apertures, which are pushed over the bottles until the carrier is positioned midway of the body of the bottles and individually grips the bottles. A pair of handles is created diagonally opposite of the apertures of the carrier. The handles move upwardly between the ranks of the bottles as the carrier is associated with the bottles.

A package and a method for producing said package is disclosed in US 57 75 486 A. In order to prevent honeycombing of the containers of adjacent multipacks each having a container positioning top carrier, and which are combined together by means of a strapping band, cardboard or other material is placed between the juxtaposed surfaces of the cylindrical containers in each group before the strapping band is applied.

SUMMARY OF THE INVENTION

An object of the present invention is to provide a cost-saving, stable and easy manageable formation of packs which avoids at least partially the mentioned drawbacks of prior art. The pack shall particularly be provided with possibly few fixation tools and shall be simultaneously carried by a person easily and conveniently.

This object of the invention is achieved with the subjects of the independent claim, wherein features of advantageous embodiments of the invention result from the respective dependent claims. For achieving this object, the present invention suggests a pack which comprises at least two PET containers combined with each other and which are held together by means of a strip-like or ribbon-like compact strapping wherein said strapping is spun about an outer surface of the PET containers in a horizontal manner. A carrier handle being fixed at the containers overstretches one top side of the pack. The carrier handle is fixed at the lateral surface areas of two PET containers which are arranged opposite of each other, next to each other or adjacent to each other. Provided that the pack comprises only two PET containers combined with each other then only these two PET containers supply the fixation of the carrier handle. As for three, four or more containers combined with each other, the carrier handle is being adjusted such that said handle is arranged in a largely symmetrical manner concerning the balance point of the pack so that the pack can be carried without tilting. The joints between the carrier handle and the PET containers are preferably placed not directly at the sides of the packs which points outwards, but are placed such that a convenient distribution of power and a convenient force application point arise at the respective container so that said container cannot tilt outwards, that is to the outer surface of the pack when lifting the pack. The joints between the carrier handle and the respective PET container are at least partially arranged within the strapping. As for a possible alternative, the carrier handle can also be adjusted at the strapping. It is also possible to slit the ends of the carrier handle and to adjust said ends at the lateral surface areas of the containers such that the strapping strip extends in between through the slit halves of the carrier handle. Essential with all alternatives is the arrangement of the carrier handle in such a way that the force application point for the respective container is situated not outside of the strapping so that the desired stability of the pack is also maintained at all times during carrying the pack.

According to an embodiment of the invention, the joint is arranged in a parallel manner between the respective PET container and the lower end of the loop-like carrier handle in a projection to the longitudinal axis of the container by an amount afar to the contact point of the lateral surface area of the container with an envelope of the pack. An envelope is to be understood in the present invention at hand as a curve which overstretches the pack at its outer surfaces in a closed curve without constrictions between adjacent containers. Said envelope can run in a parallel manner or in a congruent manner to the strapping depending on the fact if the strapping runs along the broadest point of the lateral surface area of the container or, for instance, along a recessed grip or constriction or the like of the containers. According to the present invention, the joint of the carrier handle with the lateral surface area of the container is afar from said envelope by an amount along a circumferential segment about the lateral surface area of the container wherein said amount corresponds to an angular displacement of the container about its vertical axis of at least 30 degrees, particularly of at least 60 degrees. Due to this turning of the container about at least 30 degrees alone, the force application point of the carrier handle slips from the lateral surface area of the pack in direction to the inner surface whereby the respective container does not tilt outwards while the pack is being lifted and the tension load being imposed onto the joint between carrier handle and container, but instead is being pushed in direction of a laterally adjacent container wherein the container can generally be supported without noteworthy relative movement.

According to an embodiment of the pack according to the invention, a force application point of the carrier handle is thus created at the pack within the circumference of the pack defined by the strapping and within its envelope respectively, and in a perpendicular distance to the strapping which corresponds at least to the fifth part of the diameter of the container. This amount can also be exceeded, of course, for instance with a continuing turning of the containers connected with the carrier handle. Generally, the main goal achieved by the turning shall be that the containers connected with the carrier handle do not tilt outwards because of the destabilization of the pack when the pack is being lifted. Thus, the invention enables the formation of stable packs of four or more containers of beverages which are produced in a cost-saving way with only one sole strapping and one carrier handle.

In a further embodiment of the pack, at least one of the joints between the carrier handle and the lateral surface area of the respective PET container can be arranged in a touching contact, particularly in a clamping contact with the lateral surface area of one adjacent PET container. As for this alternative, both joints are preferably arranged between the carrier handle and the lateral surface areas of the respective PET containers in a touching contact and clamping contact respectively with the lateral surface areas of the respective adjacent PET containers.

If necessary, the joints between the carrier handle and the lateral surface areas of the PET containers can be glued points and/or welded joints. The strapping can be one, two or more similar or different strips made of polymer or a composite material, wherein the strips are connected with each other at its ends by means of gluing, welding, cramping, knotting or else and in each case in an overlapping manner or through abutting. The invention is particularly advantageous when using only one strapping strip while a stabilized impact of the pack is reached with two or more strappings which can make the turning of the joints between carrier handle and the containers dispensable, if necessary.

A further feature of the pack according to the invention, which comprises two, preferably four, if necessary also five, six, seven or more PET containers connected with each other, is the already above-mentioned ribbon-like or strip-like compact strapping which is spun about the outer surface of the PET containers in a horizontally manner and with which the containers of the pack are held together. These strappings are preferably applied about the PET containers during a continuous conveying process and fixed afterwards. During the application of the strapping, the PET containers are normally not being stopped or the conveyance process delayed since the strapping can be applied about said PET containers in a continuous process during the continuous conveyance of the PET containers. An inner surface of the strapping which lies against the outer surfaces of the PET containers, can be firmly fixed, if necessary at one joint with one of the PET containers. Thus, the strapping can be fixed at the joint particularly by means of a composite material in the form of at least one welded joint. The PET containers in the pack cannot be shifted by means of such a joint, so that a defined packaging arrangement can be maintained. Optionally, this fixation can also be withdrawn so that a shifting of the containers in the above-mentioned way, particularly after the application of the loop-like carrier handle, is furthermore possible. It also makes sense to carry out the fixation after the determination of the final arrangement of the containers in the pack and after the application and the correct placement of the carrier handle so that the chosen arrangement can be retained in a reliable manner.

The optional welded joint can be a sonic weld joint or a laser weld joint, for example, or another suitable joining technique. As for thermoplastic and thermoplastic polymer respectively the material must be melted on or at least softened at the desired weld by means of supply of heat, in order to enable a material integrated bond at the junction to be welded. Thus, as for ultrasonic welding the polymers are connected together by means of mechanical vibrations. The main feature of this method is that the heat necessary for welding between the components is developed by molecular friction and surface friction in the components.

The strapping is at least one flat strip which is spun about the outer surfaces of the PET containers and afterwards connected on its ends in a pre-stressed manner. The PET containers are combined and held together with said spun strip-like or ribbon-like compact strapping so that they can be transported safely. Two or more parallely running strips can be the strapping, of course. Thus, the strapping is one, two, or more similar or different strips made of polymer or a composite material, wherein the strips are connected with each other at its ends by means of gluing, welding, cramping, knotting or else and in each case in an overlapping manner. An advantageous embodiment can be a welding of the overlapping ends of the strapping. Besides it is possible that said ends are welded on at least one PET container of the pack by means of one weld point, so that the PET containers are secured in their formation during transport. Thus, the containers of the pack cannot be shifted in different types of formation, such as from a longitudinal formation into a diagonal formation, for instance.

Here it needs to be added that the pack can consist of two, three, four or more, preferably, however, at least five or six PET containers, since the mentioned problem of shifted containers against each other occurs as recently as with packs of at least six containers combined with each other, which can fall additionally out of shape when being lifted. As for an optionally intimated alternative of the pack according to the invention, at least one welded point is added as a point of fixation on a middle PET container and/or on a further oppositely arranged PET container. Possible is also that a welded point can be provided on a PET container, wherein said container is the most external of several containers of the pack, which can be also referred to as a so called container situated in the corner.

As for a pack, whereby the PET containers are arranged in a diagonal formation, it would be also possible that a first point of fixation would be attached on a middle PET container, and a second point of fixation would be attached on a PET container arranged diagonally opposite of it. With such an alternative, the pack would not be shifted into a longitudinal formation, since the strapping is fixed at the PET containers by means of a welded point and thus no shifting of the containers would take place. The strapping should be preferably fastened with at least one point of fixation at the PET containers arranged to a pack. With two points of fixation it would make sense to arrange said two points of fixation at the PET containers arranged opposite of each other.

The PET containers held together to form a pack can be provided in each case with notches and said notches circulating in an annular form and/or extending in an horizontal direction for receiving and/or fixing of the strapping, if necessary. With such a strapping, an additional fixation of the strapping can be provided, since the applied strappings are thus fixed in their horizontal position. Furthermore, the PET containers held together to form a pack are in each case provided with a container neck underneath a top side orifice, wherein a further strapping for fixing the PET containers can be provided on said container neck. Each of these mentioned alternatives of strapping can be additionally provided, if necessary, with at least one welded point on at least one PET container of the pack and be provided during the production of the pack respectively so that the mutual shifting of the containers against each other can be prevented.

A recyclable material as a strapping and/or carrier handle is particularly advantageous, wherein said recyclable material consists of pure thermoplastic polymer, for example. Biologically degradable material is also possible for usage, if necessary, wherein said biologically degradable material can also be used as composite material with thermoplastic polymer and/or with a fibre reinforcement. A further advantage of the invention contrary to known alternatives from the prior art are amongst other things that the strapping strips as well as the carrier handles are less expensive with regard to production than a film. Said strapping strips can also be easier processed than a film. No shrinking tunnel is necessary, which results in high energy saving and a reduction of the investment costs The PET containers arranged to form a pack are provided with container surfaces which abut with each other in a pack arrangement. Said container surfaces of the PET containers can optionally be glued together at their junctions. That results in the fact that the container surfaces abutting against each other are provided in each case with at least one glue dot or with at least a double-surfaced adhesive tape. This glue is possible with packs which are arranged in a longitudinal formation or in a diagonal formation. Instead of the glue alternative, also a material integrated bond of the abutting container surfaces would be possible. Thus, one point of fixation in the form of a welded point could in each case be at least provided at the abutting container surfaces. With such aforesaid alternatives it would be possible that the PET containers are held together via so called internal points of fixation so that a strapping would be no longer necessary in the bottom region of the pack. However, a further fixation in the form of a strapping or a strip in a notch and a recessed grip respectively of the PET containers could be carried out depending on the desired stability. It is also possible that a further strapping is applied on at least two diagonally arranged containers about the container neck.

As for a further stabilization of packs, wherein the PET containers are arranged in a diagonal formation, it would be possible that a first strapping would run, for example, in the notch or in the recessed grip, and a second strapping would run about at least two container necks of a shorter diagonal of the pack. The diagonal formation of a pack can be compared with a parallelogram which has two diagonals. On the one hand a shorter diagonal and on the other hand a longer diagonal. Such a strapping, which runs about the shorter diagonal of the container necks, could also be additionally used as a carrier handle. Since the strappings are generally relatively sharp-edged, however, and thus be found unpleasant when being carried, the carrier handle which is provided and fixed at the outer surfaces of the containers is preferably and exclusively used for lifting and carrying the packs.

The carrier handle applied and fixed during, before or after the application of the strapping at the outer surface of the pack and/or at the strappings can very well contribute to an additional attitude stabilization of the formation of the pack so that the containers of beverages can only be slightly shifted against each other. The carrier handle forms a loop which overlaps the pack on its top side, wherein said loop is arranged and fixed at the outer surface of the pack and/or at the strappings.

For achieving at least one part of the above-mentioned objects of the invention, furthermore a method for the production of packs is provided, wherein the packs are formed of at least two PET containers connected with each other and which are held together by means of at least one ribbon-like or strip-like compact strapping, which is spun about one outer surface of the PET containers in a horizontal manner. The pack is being provided with a carrier handle according to the invention, which overstretches its top side wherein said carrier handle is fixed at the lateral surface areas of two PET containers arranged opposite of each other, next to each other or adjacent to each other. Thereby, the points of fixation of the carrier handle are situated at least partially within the strapping. The carrier handle can optionally be positioned in the desired way by means of turning the containers. However, it is basically also possible to arrange the carrier handle by means of suitable handling devices at a position which is optimal for the stabilization of the pack without moving or turning the containers for this purpose separately.

According to an alternative of the method according to the invention, the carrier handle is firstly being fixed at the outer surfaces of two containers which are arranged opposite of each other or adjacent to each other, wherein said containers are turned with the adjusted ends of the carrier handle by an angle about their vertical axis of at least 30 degrees and afterwards a strapping in the form of at least one strip is being applied, which is being spun about the PET containers and is being connected at its ends while applying a prestress.

The strapping can optionally be applied before the application of the carrier handle, so that in such a case the order would be firstly to form the pack, then to apply the strapping, afterwards to carry out the desired shifting and/or turning of single or of all containers and to apply the carrier handle finally. Alternatively, the carrier handle can also be applied after the strapping and before the turning and shifting of the containers respectively.

The pack is particularly advantageously being stabilized when the loosely applied carrier handle, which is fixed at the lateral surface areas of two PET containers arranged opposite of each other, next to each other or adjacent to each other, is being prestressed by the simultaneous or consecutively carried out turning of both PET containers. In this connection is can be provided for the fact that at least one of the PET containers connected with the carrier handle is being turned about its vertical axis as far as the contact point between the lateral surface area of the container and the end of the carrier handle lies and/or is clamped at the lateral surface area of the adjacent container. By means of this purpose, a repeated improvement of the stabilization of the pack, particularly during the lifting of the pack at the carrier handle, is achieved, since the two containers, at which the carrier handle is adjusted, are not being shifted outwards at their bottom surface areas of the container when being lifted, but instead are supported in the previously defined formation of packs due to the shifted force application point.

In an embodiment of the method according to the invention, the two PET containers connected with the carrier handle are firstly being turned about an angle of rotation of approximately 30 to 50 degrees about their vertical axes and are afterwards being combined with further PET containers to a pack by means of the strapping. Finally, all PET containers of this pack are in each case turned about a further angle of rotation of approximately 40 to 60 degrees until the joints between the lateral surface areas of the containers and the two ends of the carrier handle lie against at the respective lateral surface areas of the containers of the adjacent containers and/or are being clamped there. In a further advantageous alternative, four, five, six or more PET containers are firstly being combined to a pack by means of the strapping and the carrier handle being applied afterwards, wherein the PET containers connected with the carrier handle are turned about an angle of rotation of approximately 50 to 90 degrees about their vertical axes until the joints between the lateral surface areas of the containers and the two ends of the carrier handle lie against at the respective lateral surface areas of the containers and/or being clamped there.

In principle, various alternatives of the production of packs are possible which shall be explained in the following in greater detail on a pack made of six PET containers. Thereby, three parallely running conveyors are brought together at two directly consecutively arranged containers in such a way that the six pack is carried further in a compact formation. Directly after the formation of the six pack, the strapping can be applied, particularly by means of applying one sole strapping strip. The carrier handle can already be applied after the application of the strapping onto the lateral surface areas of two middle containers and being fixed there afterwards, wherein said two middle containers are arranged next to each other and are not situated at the corners of the pack, wherein said lateral surface areas of the containers are pointing at the outer surface of the pack. It can be useful in this connection to apply the carrier handle in a slightly diagonal manner, for instance in a position which is turned about approximately 15 to 30 degrees or more degrees with respect to a fixation which is applied at the outer surface of the pack. Afterwards, a shifting of the pack can be carried out by means of a suitable mechanism, for example by means of turning each respective container about an angle of rotation of approximately 45 to 60 degrees or more, by what also the positions of the joints between the ends of the carrier handle, and the lateral surface areas of the containers are shifted and turned accordingly. The turning provides preferably that the fixations of the ends of the carrier handle are placed in an exact manner at the contact points of the containers which are in each case adjacent to each other. In that way, an advantageous additional clamping of the contact point as well as a load distribution during the lifting of the pack is achieved, wherein said load distribution prevents the containers from shifting when lifting the pack, or that said containers are being tilted off the shape of the pack. Normally, a diagonally arranged pack is being formed during the turning of the containers, wherein said pack is arranged in the shape of a parallelogram and thus being arranged in the most compact formation with the creation of in each case four contact points of the containers situated at the edge of the pack wherein said containers situated at the edge of the pack are placed at the obtuse corners. After the formation of this parallelogram arrangement, the strapping can optionally be fixed either at one or two or more points, for example by gluing or welding with the lateral surface areas of the containers.

As for a modified method for the production of packs, also three parallely running conveyors are likewise brought together at two containers which are arranged directly consecutively from each other. The two containers which are conveyed at the middle conveyor belt are already provided, however, with a carrier handle before the bringing together with the outer conveyors, wherein said carrier handle overstretches the top sides of the containers and is applied and fixed afterwards in vertical direction at the lateral surface areas of the containers, which are arranged opposite of each other and are facing away from each other, for instance by means of gluing or by means of a suitable welded joint. Already directly after the application of the carrier handle and before the bringing together of the three transport lanes with the container pairs which are transported thereupon in each case, the two middle containers are turned in the same way such that the carrier handle is being led diagonally afterwards. The angle of rotation can, for example, lie between 30 and 60 degrees, particularly approximately 45 degrees. Only after this the previously separated container pairs are brought together and the closed rectangular shaped formation of the pack is being formed. The formed six pack is being carried further in a closed formation. Directly after the formation of the six pack, the strapping can be applied, particularly by means of applying one sole strapping strip. After the application of the strapping, a shifting of the pack can be carried out by means of a suitable mechanism, for example by means of turning each respective container about an angle of rotation of approximately 45 to 60 degrees or more by what also the positions of the joints between the ends of the carrier handle and the lateral surface areas of the containers are shifted and turned accordingly. The turning provides preferably that the fixations of the ends of the carrier handle are placed in an exact manner at the contact points of the containers which are in each case adjacent to each other. In that way, an advantageous additional clamping of the contact point as well as a load distribution during the lifting of the pack is achieved, wherein said load distribution prevents the containers from shifting when lifting the pack, or that said containers are being tilted off the shape of the pack. Also with this alternative, likewise a pack in the shape of a parallelogram is being formed and thus being arranged in the most compact formation with the creation of in each case four contact points of the containers situated at the edge of the pack wherein said containers situated at the edge of the pack are placed at the obtuse corners. After the formation of this parallelogram arrangement, the strapping can optionally be fixed either at one or two or more points, for example by gluing or welding with the lateral surface areas of the containers.

Finally, the present invention provides for a device for the production of packs with at least four PET containers connected with each other, wherein said PET containers are held together by means of a ribbon-like strapping which is spun about one outer surface of the PET containers in a horizontal manner. Said device is prepared and provided for the implementation of a method according to one of the embodiments previously described.

In the following, some further aspects of the invention are being mentioned. As for diagonal packs, whose packs are normally combined with two strapping strips, which is mostly a strip in an upper part of the container and a further strip below the label, the problem can arise that the packs cannot be brought into an optimal spherical packing during palletization since the lower strip fibre averts the spherical packing. Due to an optimal utilization of space onto the pallets and due to avoiding a so called over palletization (protrusion of packages over the rim of the pallet) it makes sense and is desirable respectively to do without the lower strip fibre. Besides, the application of only one strip can facilitate the technique of the machine since double strappings are no longer used. The material consumption is furthermore being reduced. Finally, advantages for the consumer can result in the fact that only one sole strapping strip has to be opened in order to reach the containers. Since the carrier handle is responsible for a straddling of the containers during the lifting of the packs due to its application at the middle containers, however, known pack formations cannot be produced without the lower strip at that point.

The method according to the invention and the formed pack thereof offer a remedy in this case by holding together and stabilizing the packs and sales units respectively by only one sole strapping strip in the recessed grip of the containers. The carrier handle is being applied in a slightly slant angle regarding a linear container formation. The container formation is being shifted after the application from the linear formation into the diagonal formation. The shifting is carried out such that the carrier handle is being turned inwards between the bottles. The force application point of the carrier handle is to be found during the carriage of the pack hence within the geometric circumference of the strapping strip. Despite the lacking lower strapping strip, thus a V-shaped straddling is being prevented at the bottom side of the containers during the carriage of the pack.

Some advantages of the pack formed thereof are for instance the compact palletization and the improved utilization of space onto the pallets by keeping the spherical packing. The carrier handle turned inwards supports and stabilizes the diagonal formation of packs during the carriage by the end consumer form the selling point (retail) to the transporter and to the point of consumption respectively. Due to the arrangement, the packaging material is being saved. The technique of the machine can be facilitated since only one strapping strip is needed per pack. The technique of applying the carrier handle is very simple since the carrier handle can be applied in the linear formation of packs. The end consumer has to open only one strip if he or she wants to take the containers of beverages from the pack.

A further advantageous aspect of the invention is to be found in the improved strapping, which is provided with a so called compensator for building the prestress during the removal of the strapping off the containers. Said compensator is created in such a way that the joints of the two overlapping ends of the strapping are created such that the strapping strips are not positioned closely between two contact joints separated from each other, wherein said contact joints can particularly be formed by welding, but that instead one side is slightly too long, i.e protruding. In this way, a sort of loop is being formed wherein the two sections of the strapping, which lie in an overlapping manner over each other, are slightly lifting off from each other. If the strapping is removed by peeling off one overlapping or protruding end, thus the welded point is firstly being split open at this overlapping end. Due to this fact, the strapping strip being under high prestress loosens firstly about a slight amount, which is being provided by the compensator. Only afterwards the now loosened strapping is being completely opened and removed by splitting open the second welded point. Since the strapping strips are normally being applied under a relatively high prestress, their removal is frequently connected with a sudden loosening, which is regarded as inconvenient by many users since the strapping strip can also sometimes spring off the pack in a whip-like manner due to its sudden loosening.

It must be stressed at this point that the equipment of the strapping strip and the strapping respectively with such a compensator is not mandatory, at least not for each strapping in the presence of several ribbons arranged one above the other. However the compensators can be very advantageous for easier manageability of the packs when the strapping strips are removed. The compensator forms a separate aspect of the strapping, which improves the handling without restriction of its function. Because one of the overlapping/protruding ends forms a sort of pull off handle of the compensator, it might be further advantageous if at least the junction facing the protruding end has a structured adhesion or welding site for influencing and/or facilitation of a detachment. The welding or the adhesion at the junction can for instance show a suitable structuring, interruptions and/or suitable shape that contribute in creating a relatively low and mostly uniform detachment force. The junction can for instance have a strip like, parabolic adhesion and/or welding that is detachable from the rounded peak along both parabola edges.

BRIEF DESCRIPTION OF THE DRAWINGS

Further features and advantages of the present invention shall now be described in greater detail according to the accompanying figures in the following detailed description. The dimensions of the individual elements to each other do not always correspond with the real dimensions since some forms are shown simplified and other forms are shown enlarged with respect to other elements for the sake of clarity.

DETAILED DESCRIPTION

Same elements refer to same reference numbers throughout the various figures. Furthermore, only reference numbers which are necessary for the description of the respective figure are shown in the various figures for the sake of clarity. The shown embodiments are only examples of how the method according to the invention can be designed and shall not be regarded as limiting the invention.

As for the pack and the sales unit respectively described in the following, several containers of beverages are combined with each other. The packs are formed by means of strapping of the containers with strings, strips made of different material such as paper, polymer, metal, and rubber seal and so on, of rigid or flexible type. Generally, all thinkable geometric arrangements of the containers are possible with the type of connection which is referred to as container strapping shown here: linear matrix arrangement in a n times m-arrangement of lines and columns for round or rectangular, cubic or other containers as well as, for example, spherical packing at an angle of approximately 30° and 60° degrees respectively with round containers in any number. The arrangement of the packs or containers depends on the feeding of the containers and their division by the so called container divider.

Figure 1:
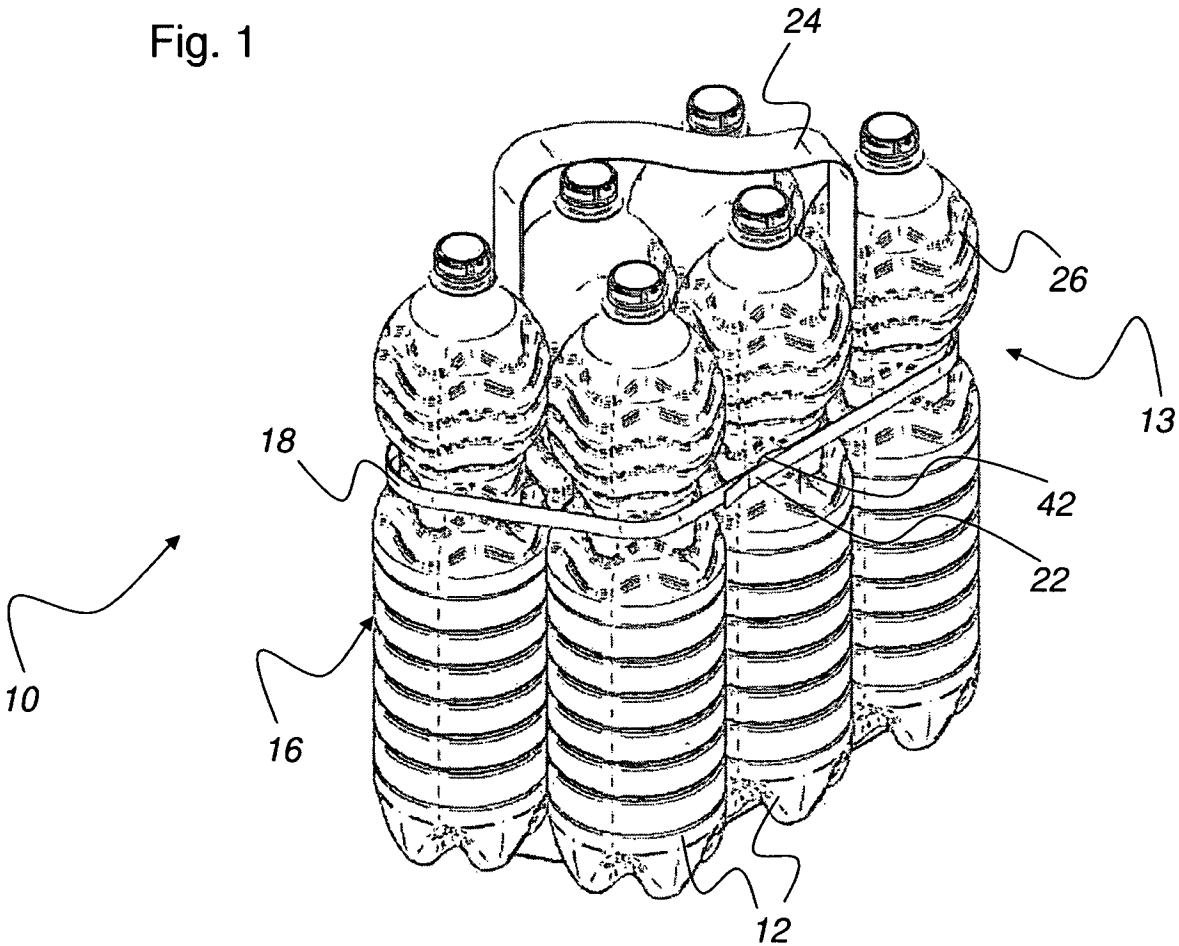
FIG. 1 shows a perspective view of a pack in a diagonal arrangement, wherein said pack is provided with a horizontal strapping and a carrier handle.
Figure 2:
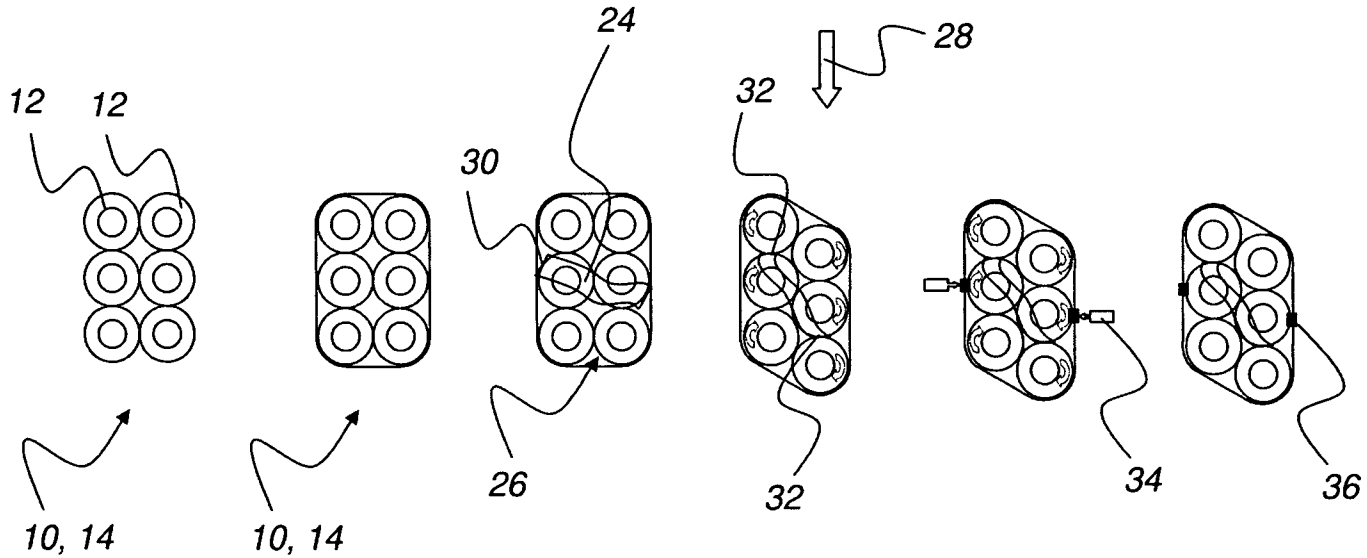
FIG. 2 shows a schematic top view of a first alternative of a formation of a pack consisting of six PET containers being combined together.
Figure 3:
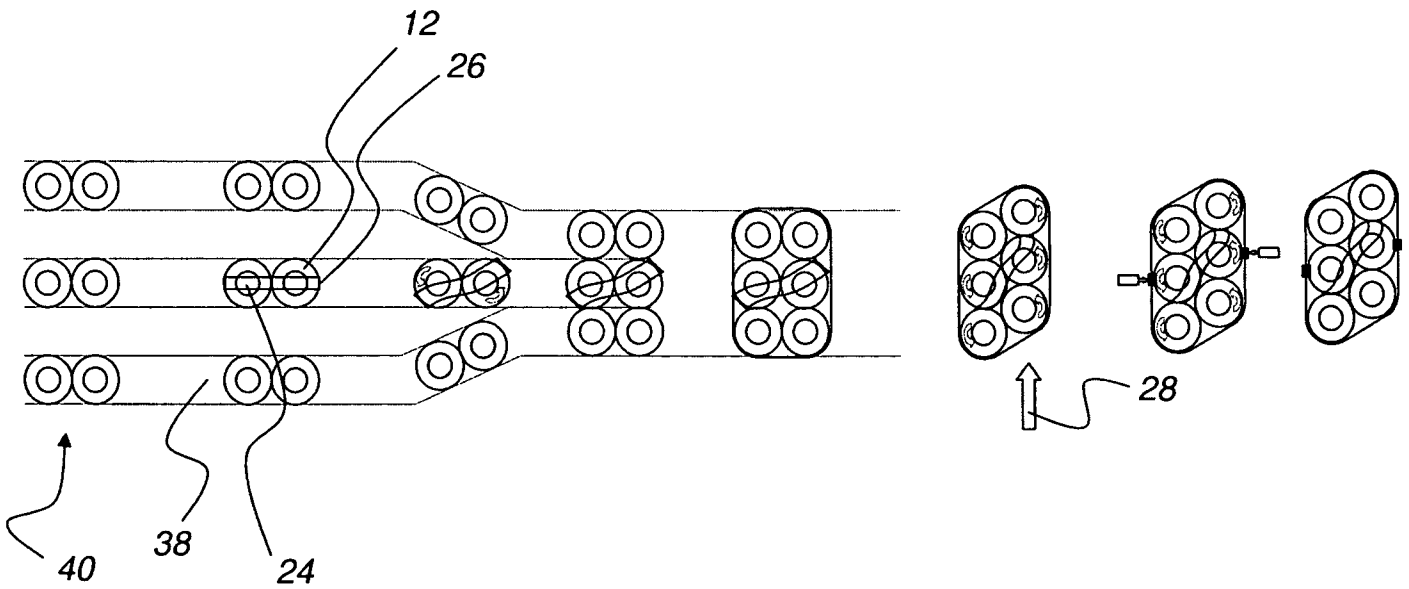
FIG. 3 shows a schematic top view of a second alternative of a formation of a pack consisting of six PET containers being combined together.

FIG. 2 and FIG. 3 show in each case schematic views of a pack 10 in top view. FIG. 1 shows, however, a perspective view of such a pack 10. As for the pack formations, containers 12 are arranged next to each other in a so called longitudinal formation 14. The pack 10 has in the example at hand six PET containers 12 connected with each other, which are being held together by means of a ribbon-like or strip-like compact strapping 18, i.e. a strap, which is spun about the outer surface 16 of the PET containers 12 in a horizontal manner. An inner surface 20 of the strapping which lies at the outer surfaces 16 of the PET containers 12 forms in the shown embodiments in each case two joints 22 with PET containers 12 arranged opposite of each other and is fixed there according a preferred alternative of the present invention. The strapping 18 is, however, not compulsory fixed at the containers 12 but can optionally be only spun about said containers 12 and be fixed with its free ends while a prestress is applied. This connection is generally being referred to in the present context as joint 22. The strapping 18 is fixed at the joint 22 by means of a composite material, for example in the form of at least one welded joint or a glued joint.

Provided that the strapping is additionally fixed at the lateral surface area of at least one of the PET containers 12, a shifting of the PET containers 12 is avoided by this fixation in the formation of the pack 14. Thus, this pack 10 remains in its respective longitudinal formation 14 or diagonal formation 15.

As pointed out in FIG. 1, a loop-like carrier handle 24 is provided which overstretches the top sides of the pack 10 in slant and diagonal direction respectively. An optimal handling of the pack 10, which is provided with only one strapping 18, is the fixation of the carrier handle 24 at points of the lateral surface area of the container 26, which are situated within the strapping 18, so that the respective container 12 does not tilt outwards during the lifting of the pack 10, which would be the case with a force application point of the carrier handle 24 outside off the strapping 18.

The strapping 18 is stretched in the embodiment shown in an upper area about the containers 12 and is situated in a so called recessed grip 13, by means of which the containers are wasted. In this way the mentioned inconvenient shifting of forces could be the case if the carrier handle 24 was arranged at the point of the largest diameter of the containers 12 and outside of the shape of the strapping 18 which would result in a possible instability of the containers 12 and the pack 10.

In principle, various alternatives of the production of packs are possible which shall be explained in the following in greater detail in FIG. 2 on a pack 10 made of six PET containers 12. Thereby, three parallely running conveyors are brought together at two directly consecutively arranged containers 12 in such a way that the six pack 10 is carried further in a longitudinal formation 14. Directly after the formation of the six pack 14, the strapping 18 can be applied, particularly by means of applying one sole strapping strip. The loop-like carrier handle 24 can already be applied after the application of the strapping 18 onto the lateral surface areas 26 of the containers 12 of two middle containers 12 and being fixed there afterwards by means of laminar or selective gluing and/or welding, wherein said two middle containers 12 are arranged next to each other and are not situated at the corners of the pack 10, wherein said lateral surface areas of the containers are pointing at the outer surface of the pack. As shown in FIG. 2, the carrier handle 24 can be applied in a slightly diagonal manner, for instance in a position which is turned about approximately 10 to 30 degrees with respect to a fixation which is applied at the outer surface 16 of the pack 10.

Afterwards, a shifting of the pack 10 (direction of shifting 28), can be carried out by means of a suitable mechanism, for example by means of turning each respective container 12 about an angle of rotation of approximately 45 to 60 degrees or more by what also the positions of the joints 30 between the ends of the carrier handle 24 and the lateral surface areas 26 of the containers are shifted and turned accordingly. The turning provides preferably that the fixations of the ends of the carrier handle 24 are placed in an exact manner at the contact points 32 of the containers 12 which are in each case adjacent to each other. In that way, an advantageous additional clamping of the contact point 30 as well as a load distribution during the lifting of the pack 10 is achieved, wherein said load distribution prevents the containers 12 from shifting when lifting the pack 10, or that said containers are being tilted off the shape of the diagonal formation 15 of the pack 10. As shown in FIG. 2, a diagonally arranged pack 10 (diagonal formation 15) is being formed during the turning of the containers 12, wherein said pack 10 is arranged in the shape of a parallelogram and thus being arranged in the most compact formation with the creation of in each case four contact points 32 of the containers situated at the edge of the pack wherein said containers situated at the edge of the pack are placed at the obtuse corners. After the formation of this parallelogram arrangement the strapping 18 can be fixed by means of suitable fixation means 34 at two points, for example by gluing or welding with the lateral surface areas 26. According to the last view (right side) of FIG. 2, two points of fixation 36 of the strapping 18 which are arranged opposite of each other are formed hereby at the outer surfaces 16 of the pack 10 and at the lateral surface areas 26 of the containers respectively.

The schematic view of FIG. 3 illustrates a modified method for the production of packs. Hereby, in each case directly consecutively arranged containers 12 are conveyed on three parallely running conveyors 38 and brought together to form a pack 10. The two containers 12 which are being conveyed on the middle conveyor belt 38, however, are already being provided with a carrier handle 24 before the bringing together with the outermost conveyor belt 38, wherein said carrier handle 24 overstretches the top sides of the containers 12 and which is arranged and fixed in vertical direction at the lateral surface areas 26 of the containers, which are situated opposite of each other and facing away from each other, for example by gluing or by means of a suitable welded joint. Already directly after the application of the carrier handle 24 and before the bringing together of the three transport lanes 38 with the container pairs 40 which are transported thereupon in each case, the two middle containers 12 are being turned in the same way such that the carrier handle 24 is being led diagonally afterwards. The angle of rotation can, for example, lie between approximately 30 to 45 degrees. Only after this the previously separated container pairs 40 are brought together and the closed rectangular shaped formation of the pack and longitudinal formation 14 is being formed. The formed six pack 10 is being carried further in a closed longitudinal formation 14. Directly after the formation of the six pack, the strapping 18 can be applied, particularly by means of applying one sole strapping strip. After the application of the strapping 18, a shifting of the pack 10 is carried out by means of a suitable mechanism in direction of the arrow 28 (direction of shifting 28), whereby the pack 10 is brought into a diagonal formation 15. The change of the formation can be carried out, for example, by turning each single container 12 about an angle of rotation of approximately 45 to 60 degrees, by what also the positions of the joints 30 between the ends of the carrier handle 24 and the lateral surface areas 26 of the containers are shifted and turned accordingly. Preferably, the turning provides that the fixations of the ends of the carrier handle are placed in an exact manner at the contact points 32 of the containers 12 which are in each case adjacent to each other. An advantageous additional clamping of the contact point 30 as well as a load distribution during the lifting of the pack 10 is achieved in that way, wherein said load distribution prevents the containers 12 from shifting when lifting the pack 10, or that said containers 12 are being tilted off the shape of the pack 10. Also with this alternative, likewise a diagonally arranged pack 10 in the shape of a parallelogram is being formed and thus being arranged in the most compact formation with the creation of in each case four contact points 32 of the containers 12 situated at the edge of the pack 10 wherein said containers 12 situated at the edge of the pack 10 are placed at the obtuse corners.

After the formation of this parallelogram arrangement, the strapping 18 can optionally be fixed by means of suitable fixation means 34 at two points, for example by gluing or welding with the lateral surface areas 26 of the containers 12. Hereby, two points of fixation 36 of the strapping 18 are created according to the next to last view (right side) of FIG. 3 at the outer surfaces 16 of the pack 10 and at the lateral surface areas 26 of the containers 12 respectively, wherein said two points of fixation 36 are arranged opposite of each other.

A shifting of the pack 10 is being prevented by the points of fixation 36, which are arranged between the lateral surface areas 26 of the PET containers 12 and the strapping 18, that is that the pack 10 remains stable for instance in its diagonal formation 15. These points of fixation 36 can be provided also with packs 10, of course, which have a longitudinal formation 14 (not shown). The composite material and the point of fixation 36 respectively does not need to be provided necessarily at the middle PET container 12. It is also imaginable that the welded joint or glued joint 36 is situated at a pack which is situated in the corner.

A further embodiment of the invention, which is not shown here, can provide for the fact that the PET containers 12 combined with each other to form a pack are in each case provided with a container neck underneath a top side orifice, where a further strapping can be arranged for fixing the PET containers.

Figure 4A:
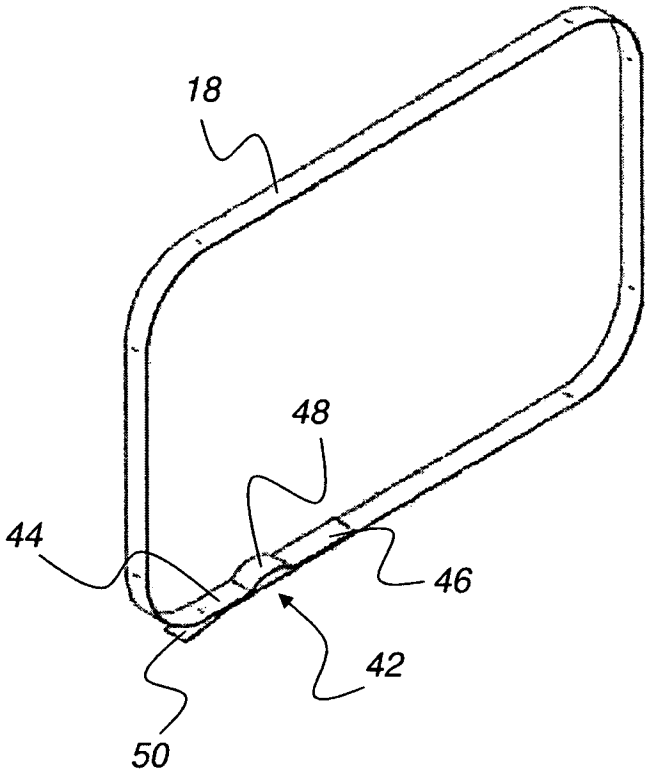
FIGS. 4*a* and 4*b* show an alternative of the strapping in two views.
Figure 4B:
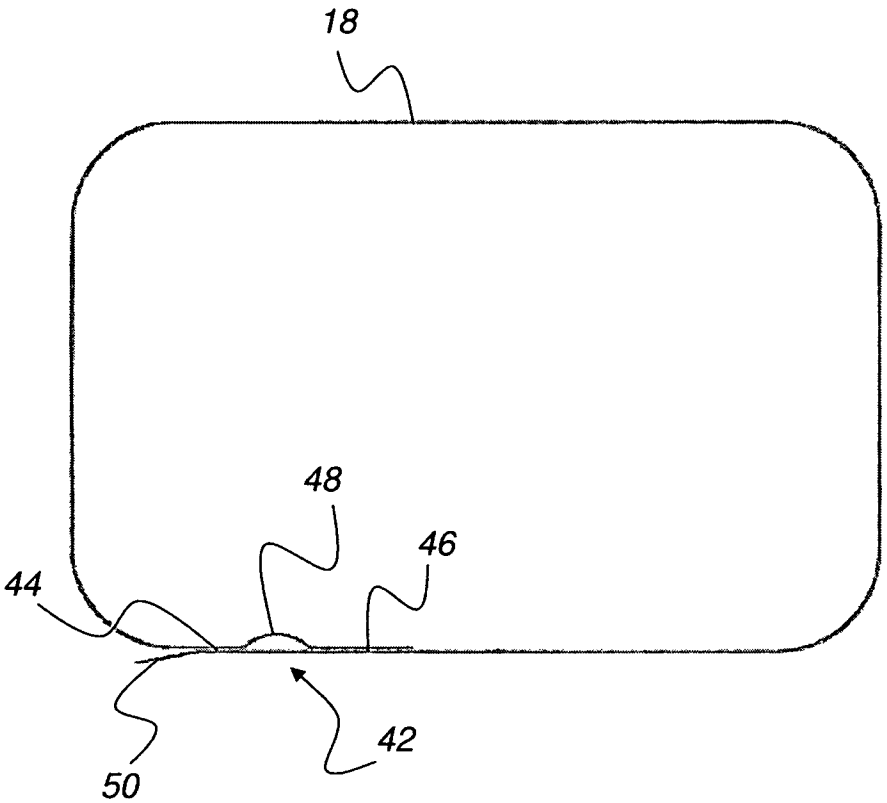

A further advantageous aspect of the invention is shown in FIGS. 4*a* and 4*b* but can also be seen, however, in FIG. 1. This alternative comprises an improved strapping 18, which is provided with a so called compensator 42 for building the prestress during the removal of the strapping 18 off the containers 12. Said compensator 42 is created in such a way that the joint 22 is formed by two contact points 44 and 46. These two joints 44 and 46 of the two overlapping ends of the strapping 18 are created such that the strapping strip 18 is not positioned closely between the two joints 44 and 46 separated from each other, wherein said joints 44 and 46 can particularly be formed by welding, but that instead one side is slightly too long. In this way, a sort of loop 48 is being formed wherein the two sections of the strapping 18, which lie in an overlapping manner over each other, are slightly lifting off from each other. If the strapping 18 is removed by peeling off one overlapping end 50, thus the welded point 44 is firstly being split open at this overlapping end 50. Due to this fact, the strapping strip 18 being under high prestress loosens firstly about a slight amount, which is being provided by the compensator 42. Only afterwards the now loosened strapping 18 is being completely opened and removed by splitting open the second welded point 46. Since the strapping strips 18 are normally being applied under a relatively high prestress, their removal is frequently connected with a sudden loosening, which is regarded as inconvenient by many users since the strapping strip 18 can also sometimes spring off the pack 10 in a whip-like manner due to its sudden loosening. This is being reliably prevented by the compensator 42 according to FIG. 4.

The invention has been described with reference to preferred embodiments. To the person skilled in the art it is also conceivable, however, to make changes and modifications to the invention without leaving the scope of protection of the appended claims.

LIST OF REFERENCE NUMBERS

10 pack
12 PET container
13 recessed grip
14 longitudinal formation
15 diagonal formation
16 outer surface
18 strapping
20 inner surface
22 junction
24 carrier handle
26 lateral surface area of the container
28 shifting direction
30 joint
32 contact point
34 fixation means
36 point of fixation
38 conveyor
40 pair of containers
42 compensator
44 joint
46 joint
48 loop
50 projecting end

What is claimed is:

1. A pack comprising:

at least two PET containers;

a strap holding together the at least two PET containers, the strap being spun about an outer surface of the PET containers in a horizontal manner; and a carrier handle overstretching a top side of the pack and fixed at lateral surface areas of two of the at least two PET containers arranged opposite of each other, next to each other or adjacent to each other, joints between the carrier handle and the respective PET containers being at least partially arranged within the strap and at a distance away from the strap; the carrier handle having two downwardly extending arms, at least one of the downwardly extending arms defining a downwardly extending plane having a first side and a second side each contacting one of the respective PET containers.

2. The pack as recited in claim 1 wherein the joints are arranged between the carrier handle and the respective PET container completely within the strap.

3. The pack as recited in claim 1 wherein the joints between the carrier handle and the respective PET container are parallely afar by an amount along a circumferential segment about the lateral surface area of the container in a projection to the longitudinal axes of the container from a contact point of the lateral surface area of the container with an envelope of the pack, wherein said envelope runs in a parallel or congruent manner to the strap, wherein the amount along a circumferential segment about the lateral surface area of the container corresponds to an angular displacement of the container about its vertical axis of at least 30 degrees.

4. The pack as recited in claim 3 wherein the angular displacement is at least 60 degrees.

5. The pack as recited in claim 1 wherein a force application point of the carrier handle is created at the pack within the circumference of the pack and an envelope respectively, wherein said circumference is defined by the strap, and is situated in a perpendicular distance to the strap, wherein said distance corresponds to at least the fifth part of the diameter of the container.

6. The pack as recited in claim 1 wherein at least one of the joints between the carrier handle and the lateral surface area of the respective PET container is in a touching contact with the lateral surface area of an adjacent PET container.

7. The pack as recited in claim 6 wherein the touching contact is a clamping contact.

8. The pack as recited in claim 1 wherein the joints between the carrier handle and the lateral surface areas of the PET containers are formed by a bonding surface and/or welded joints.

9. The pack as recited in claim 1 wherein the strap includes at least one strip made of polymer or a composite material connected at its ends.

10. The pack as recited in claim 9 wherein the ends are connected by gluing, welding, cramping or knotting and in each case in an overlapping manner, or through abutting.

11. A method for the production of packs formed of at least two PET containers combined with each other, which are held together by means of a strap, comprising:

spinning the strap about an outer surface of the PET containers in a horizontal manner; and providing the pack with a carrier handle which overstretches a top side of the pack, the carrier handle being adjusted at the lateral surface areas of two PET containers which are arranged opposite of each other, next to each other or adjacent to each other, wherein the joints between the carrier handle and the PET containers are at least partially arranged within the strap and at a distance away from the strap; the carrier handle having two downwardly extending arms, at least one of the downwardly extending arms defining a downwardly extending plane having first side and a second side each contacting one of the respective PET containers.

12. The method as recited in claim 11 wherein the containers, at which the carrier handle is being fixed, are turned before or after the application of the carrier handle or with the ends of the carrier handle adjusted thereon by an angle about their vertical axis of at least 30 degrees, and the strap being applied before or after in the form of at least one strip being spun about the PET containers, wherein the strip is connected at its free ends by the application of a prestress.

13. The method as recited in claim 11 wherein the carrier handle which is loosely applied and fixed at the lateral surface areas of two PET containers which are arranged opposite of each other, next to each other or adjacent to each other, is being prestressed by the simultaneous or consecutively carried out turning of the two PET containers.

14. The method as recited in claim 11 wherein at least one of the two PET containers connected with the carrier handle is being turned at least insofar about its vertical axis until the joint between the lateral surface area of the container and the end of the carrier handle lies against and/or is being clamped at the lateral surface area of the adjacent container.

15. The method as recited in claim 11 wherein the two PET containers connected with the carrier handle are firstly being turned about a rotation angle of approximately 30 to 50 degrees about their vertical axis, afterwards the two PET containers are being combined with further PET containers to a pack by the strap and finally all PET containers of this pack and at least the containers which are connected with the carrier handle respectively are being turned in each case about a further rotation angle of approximately 40 to 60 degrees, until the joints between the lateral surface areas of the containers and the two ends of the carrier handle lie against and/or are clamped at the respective lateral surface areas of the adjacent containers.

16. The method as recited claim 11 wherein four, five, six or more PET containers are first combined together to a pack by the strap and afterwards the carrier handle is being applied, whereby the two PET containers connected with the carrier handle are turned about a rotation angle of approximately 50 to 90 degrees about their vertical axis until the joints between the lateral surface areas of the containers and the two ends of the carrier handle lie against and/or are clamped at the respective lateral surface areas of the adjacent containers.

* * * * *